US005970700A

United States Patent [19]

Scheerer et al.

[11] Patent Number: 5,970,700

[45] Date of Patent: Oct. 26, 1999

[54] DRAFTING APPARATUS AND METHOD FOR PRODUCING YARNS

[75] Inventors: Todd Joseph Scheerer; Winston Patrick Moore; Jesse Robert Fletcher, all of Charlotte; Rudy Lee Crews, Gastonia, all of N.C.

[73] Assignee: Wellman, Inc., Shrewsbury, N.J.

[21] Appl. No.: 08/997,147

[22] Filed: Dec. 23, 1997

Related U.S. Application Data

[63] Continuation-in-part of application No. 08/844,463, Apr. 18, 1997.

[51] Int. Cl.[6] ..... D01H 5/28

[52] U.S. Cl. ..... 57/315; 19/236; 57/328; 57/333

[58] Field of Search ..... 57/315, 328, 333; 19/236, 256, 260, 261

[56] References Cited

U.S. PATENT DOCUMENTS

| | | | |
|---|---|---|---|
| 1,696,553 | 12/1928 | Owen . | |
| 3,079,746 | 3/1963 | Field, Jr. . | |
| 3,105,998 | 10/1963 | Raboisson | 19/244 |
| 3,458,987 | 8/1969 | Ozawa et al. . | |
| 3,487,619 | 1/1970 | Field, Jr. . | |
| 3,596,456 | 8/1971 | Quick et al. | 56/130 |
| 3,646,745 | 3/1972 | Baldwin et al. . | |
| 4,088,016 | 5/1978 | Watson et al. | 73/160 |
| 4,369,622 | 1/1983 | Teed et al. | 57/315 |
| 4,387,487 | 6/1983 | Nakahara et al. . | |
| 4,461,058 | 7/1984 | Gaudino . | |
| 4,512,061 | 4/1985 | Hartmannsgruber et al. . | |
| 4,644,609 | 2/1987 | Lattner | 19/244 |
| 4,667,463 | 5/1987 | Minorikawa et al. | 57/328 |
| 4,845,813 | 7/1989 | Salaun, Jr. et al. . | |
| 5,038,553 | 8/1991 | Stalder et al. . | |
| 5,400,476 | 3/1995 | White | 19/239 |
| 5,481,863 | 1/1996 | Ota | 57/328 |

FOREIGN PATENT DOCUMENTS

| | | |
|---|---|---|
| 222981 | 8/1986 | European Pat. Off. . |
| 0372255 A1 | 6/1990 | European Pat. Off. . |
| 2268096 | 4/1975 | France . |
| 4225243 | 2/1993 | Germany . |
| 4308392 | 9/1993 | Germany . |

*Primary Examiner*—William Stryjewski
*Attorney, Agent, or Firm*—Philip Summa

[57] ABSTRACT

A drafting and spinning apparatus is disclosed that produces highly uniform yarns with improved mechanical properties. The apparatus comprises a plurality of pairs of drafting rolls for drawing a sliver formed of one or more types of staple fibers, each fiber type having a predetermined effective fiber length. The plurality of pairs of drafting rolls comprises at least two pairs of intermediate rolls, with the distances between the nips of adjacent intermediate roll pairs being no more than the effective fiber length of the longest fiber type in the sliver. The apparatus further includes device for spinning the sliver into yarn at a take-up speed of greater than 150 meters/minute.

22 Claims, 6 Drawing Sheets

DRAFTING APPARATUS AND METHOD FOR PRODUCING YARNS

FIELD OF THE INVENTION

This application is a continuation-in-part of Ser. No. 08/844,463 filed Apr. 18, 1997. The present invention relates to yarn spinning and more particularly, relates to a novel method of drafting sliver in a spinning apparatus to form highly uniform yarns having good mechanical properties.

BACKGROUND OF THE INVENTION

One common method of forming single yarns has been the use of a spinning apparatus which drafts and twists prepared strands of fibers to form the desired yarn. One of the first yarn spinning apparatus was the mule spinning frame which was developed in 1782 and used for wool and cotton fibers. Many decades later, the ring spinning apparatus was developed to increase the spinning speed and quality of the spun yarn. Although good quality natural yarns may be produced by ring spinning, the rate of ring spinning remains relatively slow, e.g., less than about 15 meters/minute. In the last few decades, other various types of spinning apparatus which operate at higher speeds than ring spinning apparatus have been introduced. For example, rotor spinning, friction spinning and air-jet spinning methods are capable of spinning sliver into yarn at speeds greatly exceeding ring spinning speeds.

Prior to spinning sliver into yarn, the fibers are typically processed by carding and other various methods and then drawn to attenuate or increase the length per unit weight of the sliver. The sliver is generally drawn in a drafting zone comprising a series of drafting roll pairs with the speed of successive roll pairs increasing in the direction of sliver movement to draw the sliver down to the point where it approaches yarn width. Numerous parameters have traditionally been adjusted in the drafting zone to attempt to maximize the drafting and quality of the sliver including draft roll spacings, draft roll diameters, draft roll speeds (ratios), draft distribution, and fiber blending (e.g., draw-frame and/or intimate blending).

One particular parameter, the draft roll spacing between adjacent roll pairs, is normally defined by the distance between the nip, i.e., the line or area of contact, between one pair of rolls and the nip of an adjacent pair of rolls.

The conventional wisdom for draft roll spacings, especially for higher speed spinning processes such as air jet spinning, has been to set the distance between adjacent nips at greater than the fiber length of the staple fibers in the sliver. See, e.g., U.S. Pat. No. 4,088,016 to Watson et al. and 25 U.S. Pat. No. 5,400,476 to White. This particular roll spacing has been widely accepted as the industry standard based on the rationale that smaller roll spacing results in increased breakage of fibers. Specifically, when the roll spacing is less than the fiber length, individual fibers may extend from one nip to an adjacent nip or bridge adjacent nips. Because adjacent pairs of rollers operate at different speeds, the bridged fibers may become pulled apart thus resulting in breakage of the fibers. This fiber breakage can result in low yarn quality and even yarn breakage in subsequent processing equipment such as spinning apparatus which may require the processing equipment to be shut down. Thus, draft roll spacings of greater than the fiber length have been the standard in the textile industry. The standard draft roll spacings produce yarns having good uniformity and mechanical properties. Nevertheless, there is always a need in the art to improve the uniformity and the mechanical properties of the yarn. Several attempts have been made to the drafting and spinning process to improve certain aspects of the spun yarn. For example, U.S. Pat. No. 5,481,863 to Ota describes decreasing the distance between the nip of the front roll pair of drafting rolls and the nip of the delivery rolls (located after spinning) to less than the longest fiber length to reduce ballooning in the air nozzles of the spinning apparatus. Additionally, U.S. Pat. No. 3,646,745 to Baldwin describes decreasing the distances between the nips of the front pair and the adjacent intermediate pair of drafting rolls to less than the effective staple length of the fibers in ring spinning processes to reduce the formation of "crackers" caused by overlength staple fibers. Nevertheless, no drafting takes place between the narrowly spaced rolls described in these patents and thus the problem of fiber breakage is not a danger in decreasing the roll spacings in these patents.

Parent application Ser. No. 08/844,463 ("the '463 application" disclosed that the uniformity and mechanical properties of spun yarn, particularly air-jet spun yarn, could be greatly enhanced by drafting sliver through a four-roll drafting zone in which the distance between the back roll pair and the adjacent intermediate roll pair, were both no more than the effective fiber length of the longest fiber type in the sliver.

Applicants have now additionally discovered, however, that yarn uniformity and mechanical properties can be similarly enhanced by maintaining the distance between the nip of intermediate roll pairs at no more than the effective fiber length of the longest fiber type in the sliver while maintaining a distance at the effective fiber length between the nip of the back roll pair and the nip of the adjacent intermediate roll pair.

OBJECT AND SUMMARY OF THE INVENTION

The present invention thus provides a drafting and spinning apparatus that produces highly uniform yarns with improved mechanical properties. The spinning and drafting apparatus of the invention preferably comprises at least four pairs of drafting rolls for drawing a sliver formed of one or more types of staple fibers, each fiber type having a predetermined effective fiber length. The pairs of drafting rolls include a pair of back rolls, at least two pairs of intermediate rolls, and a pair of front rolls. The drafting roll pairs are spaced such that the nip of each of the drafting roll pairs is separated from the nip of the adjacent roll pairs by a predetermined distance such that the distances between the nips of adjacent intermediate rolls is no more than the effective fiber length of the longest fiber type in the sliver. The drafted sliver is thereafter spun into yarn by spinning means, preferably at a take-up speed of greater than 150 meters/minute.

In an alternative embodiment, the present invention provides a method of producing highly uniform yarns with improved mechanical properties comprising advancing a sliver formed of one or more types of staple fibers, each staple fiber type having a predetermined effective fiber length, through at least four pairs of drafting rolls by maintaining the nip distance between adjacent pairs of intermediate rolls at no more than the effective fiber length of the longest fiber type in the sliver and thereafter spinning the sliver into yarn, preferably at a take-up speed of greater than 150 meters/minute. Preferably, the sliver comprises staple polyester fibers having a predetermined mean decrimped fiber length and typically will consist of blends of between about 20% and 100% polyester fibers and between about 80% and 0% cotton fibers. The polyester fibers used in the invention preferably are high cohesion fibers having a denier per filament of between about 0.5 and about 2.5 and a mean decrimped fiber length of less than about 2.00 inches.

In yet another embodiment of the invention, the present invention includes a spun yarn consisting of a blend of polyester and cotton fibers forming a parallel fiber core held together by wrapping fibers and having a mean tenacity of at least about 1.91 gf/den, a mean single-end strength of greater than about 275 gf, a maximum strength of greater than about 376 gf, and less than 1947 total defects (thin, thick, and nep) per 1000 yards. The present invention provides a drafting and spinning apparatus which produces highly uniform yarns having improved mechanical properties. Specifically, the yarns produced according to the invention have increased strength and fewer defects than similar yarns produced according to conventional processes.

These and other advantages of the present invention will become more readily apparent upon consideration of the following detailed description and accompanying drawings which describe both the preferred and alternative embodiments of the invention.

DETAILED DESCRIPTION OF THE INVENTION

Figure 1:
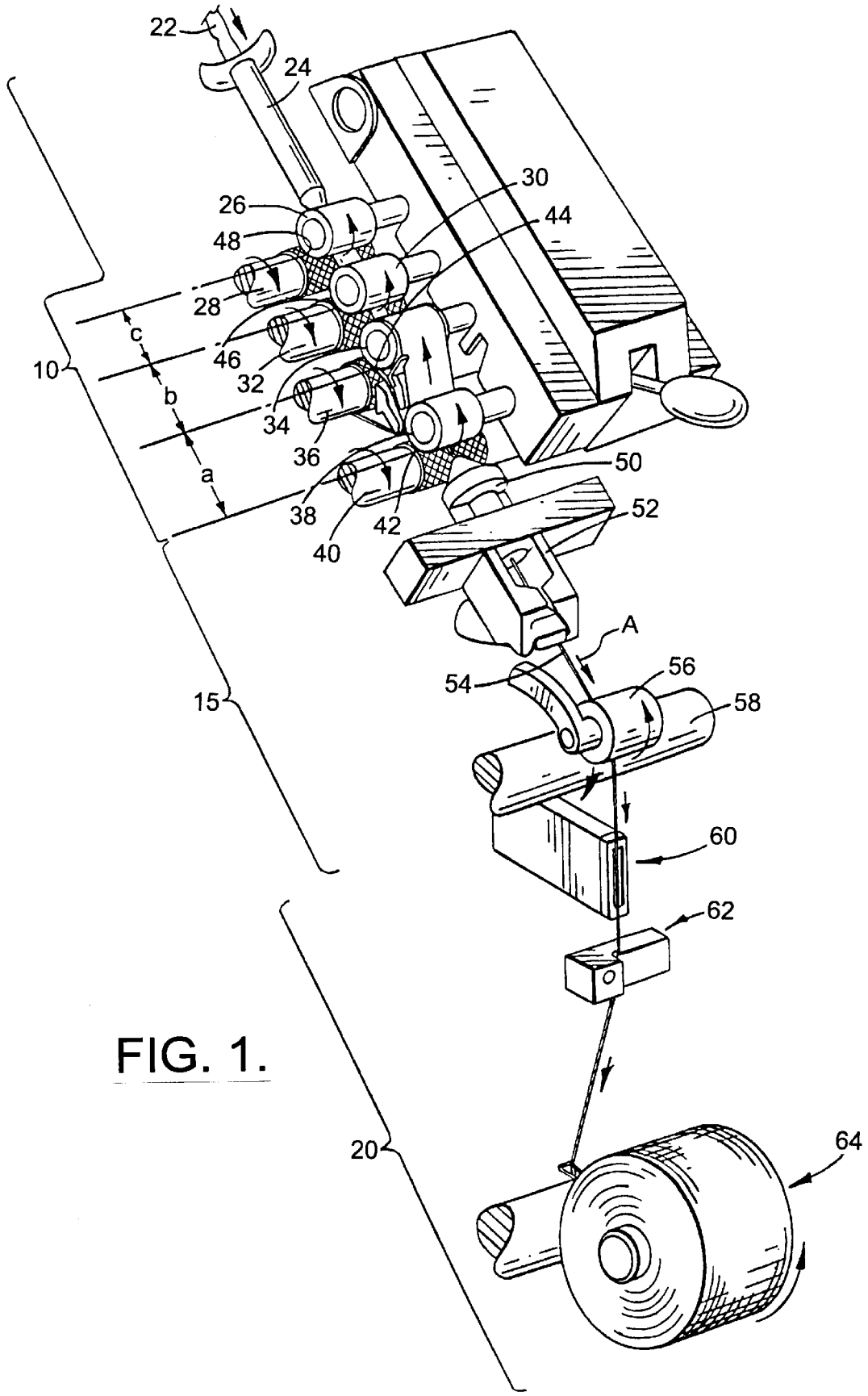
FIG. 1 is a perspective view of a drafting and spinning zone according to the present invention.

FIG. 1 illustrates a drafting and spinning apparatus according to the invention. As shown in FIG. 1, the drafting and spinning apparatus may be divided into a drafting zone 10, a spinning zone 15, and a take-up zone 20.

In the operation of the drafting and spinning apparatus of the invention, a sliver 22 of staple fibers is advanced to the drafting zone 10. The sliver 22 may be processed prior to entering the drafting zone 10 using otherwise conventional steps such as opening, blending, cleaning, carding and combing to provide the desired characteristics in the sliver for drafting and spinning. The sliver 22 used in the invention comprises one or more types of staple fibers, each staple fiber type having a predetermined effective fiber length.

The present invention is based on increased knowledge of the relationship of the effective fiber length to draft roll spacings. The "effective" fiber length was defined in application Ser. No. 08/844,463 as the mean decrimped fiber length of the fiber component prior to use in the sliver 22. This application also stated that the mean decrimped fiber length could be determined by fiber array testing of the fibers as described in ASTM method D-5103. However, staple fiber is very difficult to decrimp manually for ASTM D-5103. To ensure a more accurate determination of the effective fiber length, measurement of three-process drawn sliver containing 100% of the fiber to be studied is recommended.

For sliver blended with two fiber types with different length distributions, one should examine the appropriate portion of the third pass sliver length distribution which represents the longest fiber type present. For example, a blend of 50% nominal 1.5 inch Fortrel® polyester and 50% cotton three-process drawn sliver was examined. As known to those in this art, the actual length of any given fiber can differ slightly from its nominal length based on a number of factors.

To determine the effective fiber length in the sliver, the upper quartile length (i.e., the length for which 75% of the fibers are shorter and 25% are longer) was chosen. This length was selected because the cotton length distribution differs enough from the polyester length distribution to make a "mean" fiber length of the blend somewhat meaningless. Thus determining the mean length of the polyester portion of the sliver requires measuring the upper quartile length of the blend.

It will also be understood that blends that are the same composition by weight can, of course, differ in effective fiber length in one or more of the components of the blend. Nevertheless, those skilled in the art will be able to make similar selections for length measurement and without undue experimentation based on the nominal length of polyester or the type of cotton present in any particular blend, both which are generally known or indeed selected for such blends. It will be further understood that the goal is the measurement of the longest fibers in any blend and that in certain cases the cotton (or other) fibers will be longer than the polyester fibers.

Once the effective fiber length of the sliver is determined, a superior yarn is produced through the present invention of adjusting roll spacings to less than the effective fiber length between the two pairs of intermediate rolls and to the effective fiber length between the pair of back rolls and the adjacent pair of intermediate rolls.

The sliver 22 used in the invention includes one or more types of staple fibers including cut synthetic fibers, natural fibers, and blends thereof. Exemplary types of synthetic fibers include polyesters (e.g., polyethylene terephthalate, polytrimethylene terephthalate), rayon, nylon, acrylic, acetate, polyethylene, polyurethane and polyvinyl fibers. Exemplary types of natural fibers include cotton, linen, flax, rayon, lyocell, viscose rayon, cellulose acetate, wool, ramie, alpaca, vicuna, mohair, cashmere, guanaco, camel, llama, fur and silk fibers. Preferably, the staple fibers used in the invention are polyester (polyethylene terephthalate) fibers, either alone, or blended with cotton fibers. For example, the sliver may consist of between about 20% and 100% polyester fibers and between about 80% and 0% cotton fibers. Typically, the polyester fibers have a cut length of between about 1.25 inches and 2.00 inches, preferably between 1.25 inches and 1.60 inches and a denier per filament of between about 0.5 and 2.5, preferably, between 0.7 and 1.5. The polyester fibers used in the sliver 22 preferably have high cohesion for use in the drawing and spinning apparatus of the invention. The high cohesion of the polyester fibers may be achieved by any suitable means known in the art such as the application of liquid finishes to the polyester fibers.

As shown in FIG. 1, the sliver 22 is advanced through a trumpet guide 24 which gathers the staple fibers together and then to a series of drafting roll pairs. The series of drafting roll pairs includes a pair of back rolls 26 and 28; at least one pair of intermediate rolls (FIG. 1 illustrates two pairs at 30 and 32, and 34 and 36); and a pair of front rolls 38 and 40. Preferably, as shown 15 in FIG. 1, the pair of intermediate rolls 34 and 36 adjacent the pair of front rolls 38 and 40 is a pair of apron rolls. For use in the invention, the series of drafting rolls preferably consists of at least four pairs or drafting rolls as, for example, the four roll pair arrangement illustrated in 20 FIG. 1. Nevertheless, the may also be applied to three roll pair arrangements having only one intermediate pair of drafting rolls.

Figure 2:
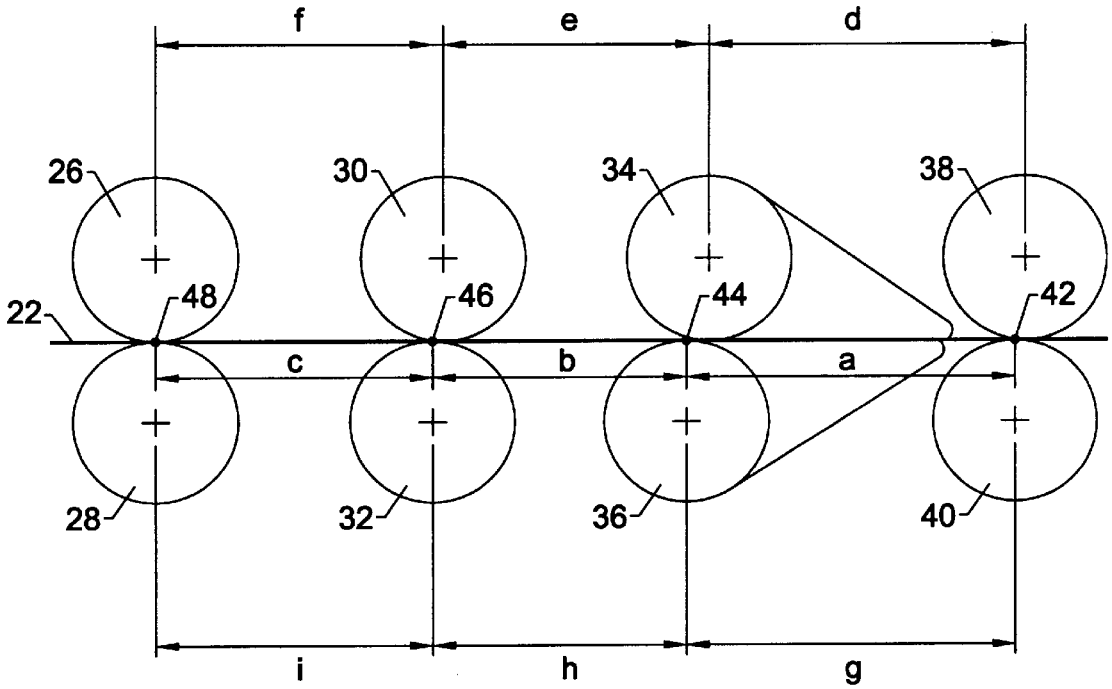
FIG. 2 is a side plan view of a drafting zone according to the invention.

The pairs of drafting rolls in the drafting zone 10 operate such that the speeds of the roll pairs increase in the direction of sliver movement as indicated, e.g., by directional arrow A, thereby drafting the sliver 22 down to yarn size. As illustrated in FIG. 1, typically the top roll 26, 30, 34 and 38 in the roll pair, rotates in a direction opposite that of the bottom roll 28, 32, 36 30 and 40 in the roll pair. As is well known to those skilled in the art, the ratio between the weight or length of the sliver 22 fed into the drafting zone 10 and the weight or length of the sliver exiting the drafting zone is known as the draft ratio. The draft ratio may also be measured across individual roll pairs such as the back draft (between the back rolls and the intermediate rolls), the intermediate draft (between the intermediate rolls and the apron rolls), and the main draft (between the apron rolls and the front rolls). Preferably, in the present invention, the overall draft ratio is between about 50 and about 220, and more preferably between about 130 and about 200. Typically, the majority of drafting occurs in the main draft. The width of the sliver 22 and thus the draft ratio may be affected by the speeds selected for the drafting rolls or a sliver guide (not shown) located between adjacent rolls pairs such as intermediate roll pairs 30 and 32, and 34 and 36. In the drafting zone 10, the distances between adjacent roll pairs or nips are typically preset depending on numerous factors including the staple fiber length, break draft and fiber cohesive forces. As illustrated in FIGS. 1 and 2, the distances between adjacent nips 42 (for the front roll pair), 44 (for the apron roll pair), 46 (for the intermediate roll pair) and 48 (for the back roll pair) are a, b and c, respectively. The distance between nips may be fairly approximated by averaging the distance between adjacent top rolls and the distance between corresponding adjacent bottom rolls. For example, if the spacings (FIG. 2) between adjacent top rolls are d=48 mm, e=37 mm, and f=35 mm, respectively, and 25 the spacings between bottom rolls are g=44 mm, h=35 mm and i=35 mm, respectively, than the distances a, b and c, between adjacent nips would be a=46 mm, b=36 mm and c=35 mm. respectively. In addition to the roll spacings, various diameters for the drafting rolls may be selected for use in 30 the invention and larger diameter rolls may be selected to further increase contact with the sliver 22 and thus increase the quality of the resulting spun yarn.

The conventional wisdom regarding roll spacing for a drafting zone 10 has been to set the distance between nips in adjacent drafting roll pairs to a distance greater than the staple fiber length to prevent individual fibers from bridging adjacent pairs of drafting rolls and breaking. Parent application Ser. No. 08/844,463 disclosed, however, that narrowing the distance between the nip 48 of the back rolls and the nip 46 of the adjacent intermediate rolls and the distances between the nips of adjacent intermediate rolls (e.g., 46 and 44) to no more than the effective fiber length of the longest fiber type in the sliver 22 results in spun yarns having greater uniformity and mechanical properties, particularly for high-speed spinning processes (i.e., 150 meters/minute). For example, if the sliver 22 consists of 80% cotton fibers having an effective fiber length of 1.0 inch and 20% polyester fibers having an effective fiber length of 1.5 inches, then the distances b and c would be no more than 1.50 inches (38 mm), and may be 36 mm and 37 mm, respectively. The longest fiber type in the sliver 22 refers to the fiber type having the longest effective fiber length and forming a substantial portion of the sliver 22. Stated differently, fiber types which do not constitute a significant portion of the sliver are not used to determine the longest fiber type in the sliver and thus the roll spacing in the drafting zone 10.

Figure 3:
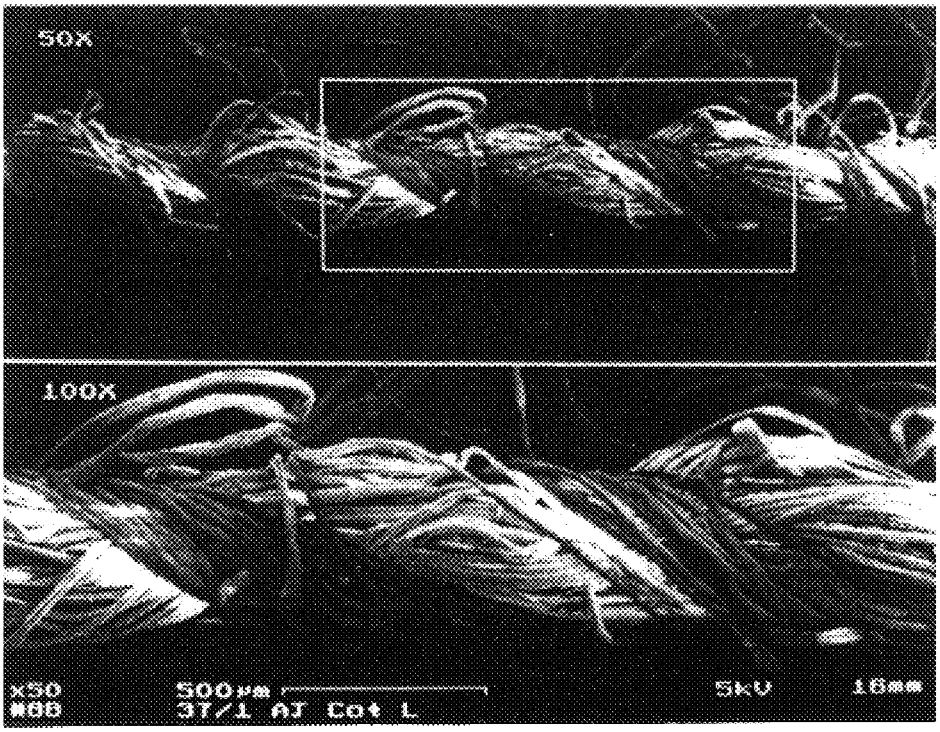
FIG. 3 is a microscopy photograph of an air-jet spun yarn produced according to the present invention.
Figure 4:
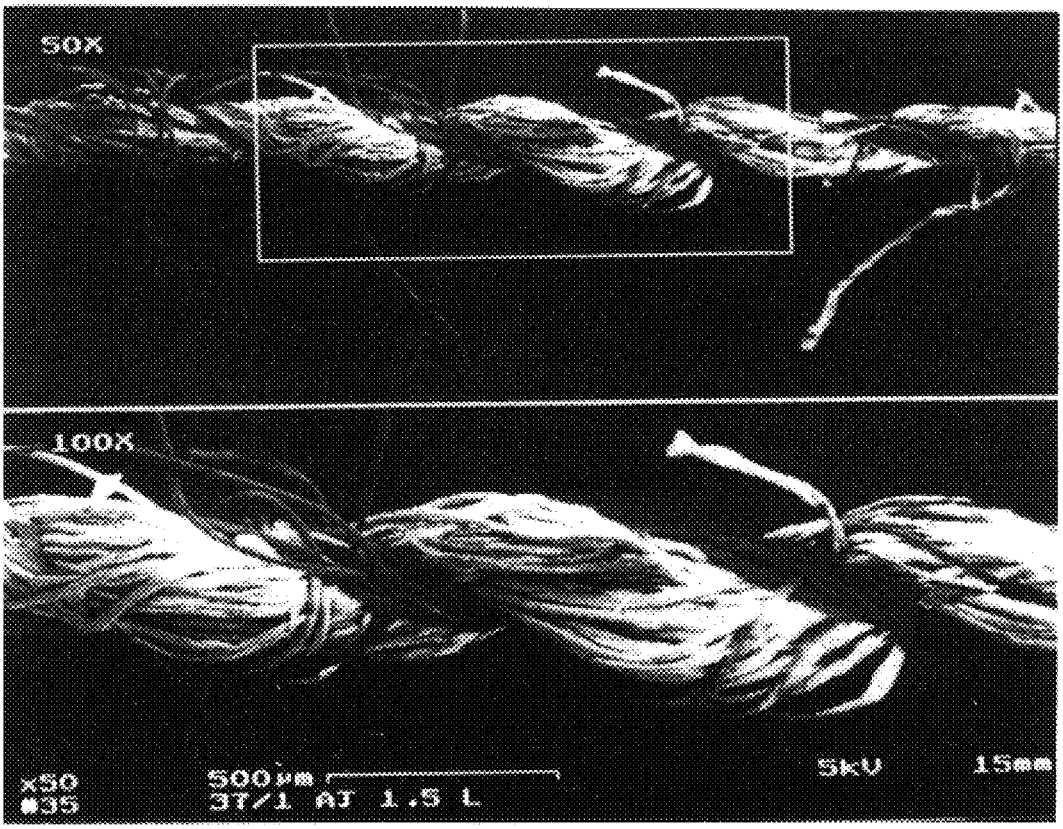
FIG. 4 is a microscopy photograph of an air-jet spun yarn produced according to the conventional method of drawing sliver to form yarn.

Although not wishing to be bound by a particular theory, it is believed that roll spacings tighter than the effective fiber length of the longest fiber type in the sliver 22 in the break and intermediate draft zones reduce fiber slippage at each nip point and thereby increase drafting control on the sliver. This greater control increases fiber alignment and uniformity in the drafted sliver 22 as it is introduced to the front drafting zone. A high cohesion sliver is preferred because it is believed to prevent fibers from slipping under the higher drafting force generated by the tighter roll spacings. Because the sliver 22 entering the front drafting zone is highly uniform and aligned because of the tighter roll spacings, the sliver 22 exits the front roll nip even more uniform and aligned. Accordingly, the more uniform and aligned sliver entering the spinning zone 15 creates a unique spun yarn. Upon examination of the spun yarns through microscopy, more wrapper fibers appear to be generated in this yarn (FIG. 3) at the same spinning conditions than with yarn produced from sliver drafted with the conventional wider roll spacings in the back and intermediate drafting zones (FIG. 4). It is believed that the number and frequency of the wrapper fibers increase because of the greater fiber alignment in the sliver 22. The greater number of wrapper fibers combined with the more uniform and aligned sliver going into the spinning zone is believed to create a spun yarn with increased strength and reduced quality defects. Furthermore, the improvements in the yarn may result in improvements in the weaving performance of the yarn and the potential use of yarns, specifically air-jet yarns, in some knit applications. In addition to the above, it is believed that the speed and the mass of the sliver 22 used in the drafting zone 10 may contribute to the benefits of the invention. By way of example, in four-roll systems used according to the invention, the speed in the break and intermediate draft zones is about 3 times faster at the second nip roll than in ring spinning draft systems. The mass of the sliver 22 entering the drafting zone 10 is also typically 2 times greater than the roving entering a typical ring spinning draft system. The combination of greater speed and fiber mass is believed to make fiber slippage at the nip points more likely in the higher speed four-roll drafting system (e.g., MJS drafting system) thus providing the benefits of the invention in the higher speed four-roll system and not in ring spinning systems.

Once the sliver 22 exits the drafting zone 10, it is advanced to the spinning zone 15. The spinning apparatus in the spinning zone 15 selected for use in the present invention operates at higher speeds than associated with ring spinning. Exemplary spinning means which operates at these speeds and which use roller drafting systems include air-jet spinning means and roller jet spinning means. Generally, the spinning means operates at a take-up speed of greater than about 150 meters/minute, preferably, of greater than about 190 meters/minute and more preferably, of greater than about 220 meters/minute. The spinning apparatus is typically capable of producing yarns having counts between 9 and 50, preferably 26 and 42. An exemplary spinning apparatus is an air-jet spinning apparatus such as the MJS 802H spinning apparatus is from Murata Machinery Limited.

FIG. 1 illustrates an air-jet spinning apparatus for use in the invention. In the spinning zone 15, the sliver 22 enters a jet spinner 50 and air nozzle 52 wherein the drafted sliver is twisted by opposing air vortices to form a yarn 54. The spun yarn 54 is then advanced to the take-up zone 20 and specifically, to a pair of delivery rolls 56 and 58. The spinning zone 15 also includes a slack tube 60 to hold any accumulated fiber during the start-up of the drafting and spinning apparatus. The yarn 54 is then cleared by a yarn clearer 62 and collected on a take-up roll 64.

As described above, the spun yarn produced according to the invention has high uniformity and improved mechanical properties over conventional yarns produced according to conventional constructions having broader roll spacing. Specifically, the spun yarn produced according to the invention has increased strength and reduced defects over conventional yarns formed using broad roll spacing. The benefits of the present invention will now be further illustrated by the following non-limiting example.

EXAMPLE 1A AND COMPARATIVE EXAMPLES 1B AND 1C

Two slivers consisting of two cut length variations of intimately blended 50% 0.9 denier per filament FORTREL® Type 510 polyester (available from Wellman, Inc.) and 50% cotton stable fibers were advanced through a four roll drafting zone and spun using an MJS 802H air-jet spinner from Murata Machinery Limited with an H3 air nozzle at a speed of 273 meters/minute. The air-jet spinning apparatus was preset at a feed ratio of 0.98, a condenser setting of 3 mm, an apron spring tension of 3 kg, a Nozzle 1 (Nl) to front roll distance 10 of 39.0 mm, a Nl pressure of 2.5 kgf/CM2 and a Nozzle 2 (N2) pressure of 5 kgf/CM2. The effective fiber length of the 35 gr/yd three-process drawn slivers were measured using ASTM D-5103. The upper quartile length of the slivers, representing the mean decrimped length of the polyester fiber in each sliver, was 38 and 39 mm respectively. The polyester fibers had high cohesion through the use of liquid finishes and for these particular samples the Rothschild cohesion of the sliver was 182 cN for both variants. The yarn count of the spun yarn was measured at 37 Ne. In Example 1A, a narrow roll spacing was selected according to the invention wherein the top roll spacings were preset at 48 mm, 37.5 mm, and 39 mm (d, e and f, respectively, in FIG. 2) and the bottom roll spacings were preset at 44 mm, 39 mm and 38 mm (g, h and i, respectively, in FIG. 2). The distances between the nips were 46 mm, 38.25 mm and 38.5 mm (a, b and c, respectively in FIG. 2). The draft ratio across the drafting zone was 155 consisting of a break draft of 2.0, an intermediate draft of 2.17 and a main draft of 36. The sliver used for example 1A had a 39 mm effective fiber length in order to be slightly longer than the 38.25 mm intermediate drafting zone. In Comparative Examples 1B and 1C, sliver exhibited an effective fiber length of 38 mm. In Comparative Example 1B, narrow roll spacings such as those presented in parent application Ser. No. 08/844,463 were utilized. The top roll spacings were preset at 48 mm, 36 mm, and 36 mm (d, e and f, respectively, in FIG. 2) and the bottom roll spacings were preset at 44 mm, 37 mm and 36 mm (g, h and i, respectively, in FIG. 2). The distances between the nips were 46 mm, 36.5 mm and 36 mm (a, b and c, respectively in FIG. 2). In Comparative Example 1C, a broad roll spacing such as those conventionally used in the art was selected wherein the top roll spacings were preset at 48 mm, 39 mm, and 42 mm (d, e and f, respectively, in FIG. 2) and the bottom roll spacings were preset at 44 mm, 41.5 mm and 42 mm (g, h and i, respectively, in FIG. 2). The distances between the nips were 46 mm, 40.25 mm and 42 mm (a, b and c, respectively in FIG. 2). The draft ratio used was the same for Examples 1A, 1B, and 1C.

Figure 5:
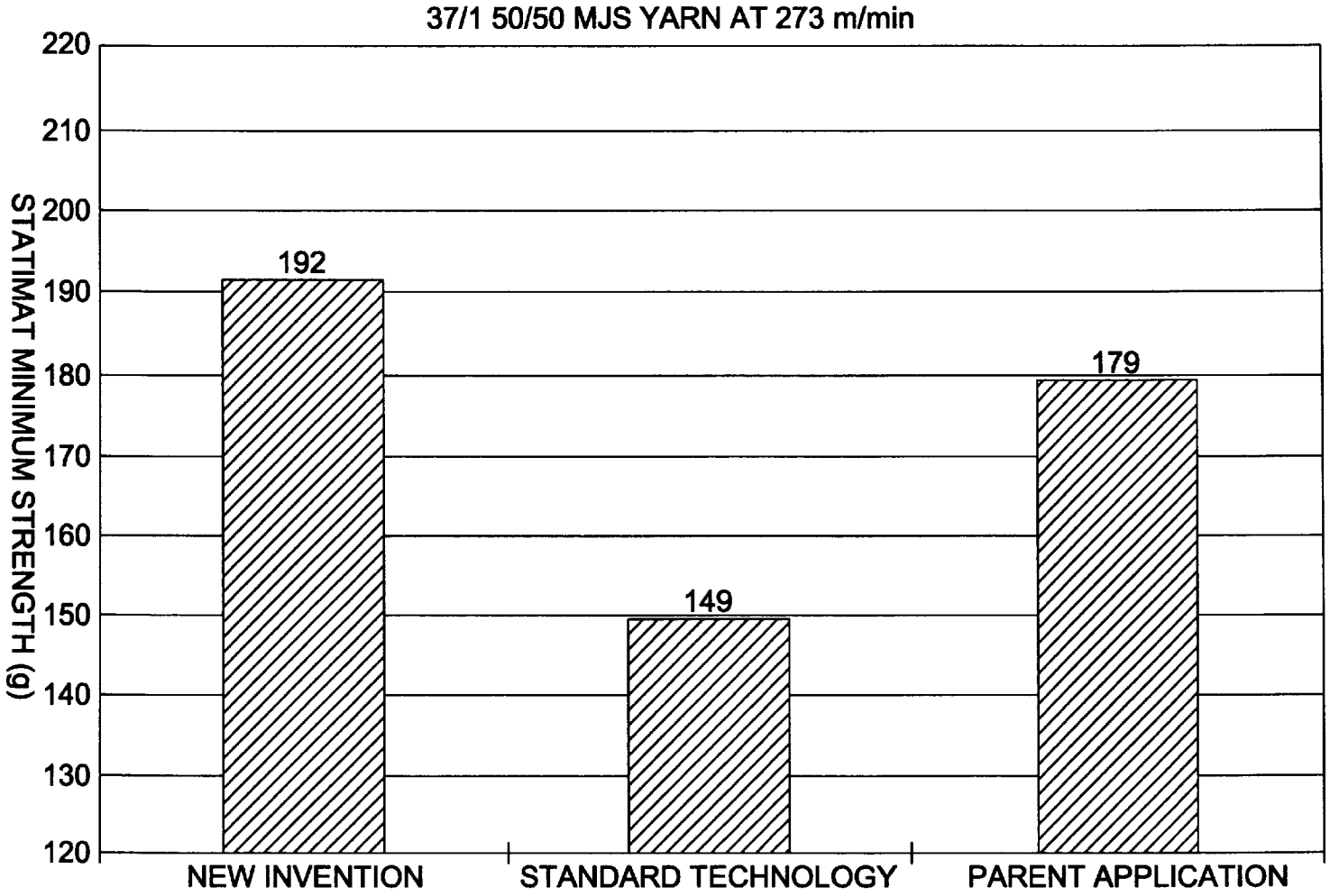
FIGS. 5, 6 and 7 are charts respectively comparing minimum strength, mean strength and certain types of defects among yarns formed conventionally, those formed according to parent application Ser. No. 08/844,463, and those formed according to the present invention.
Figure 6:
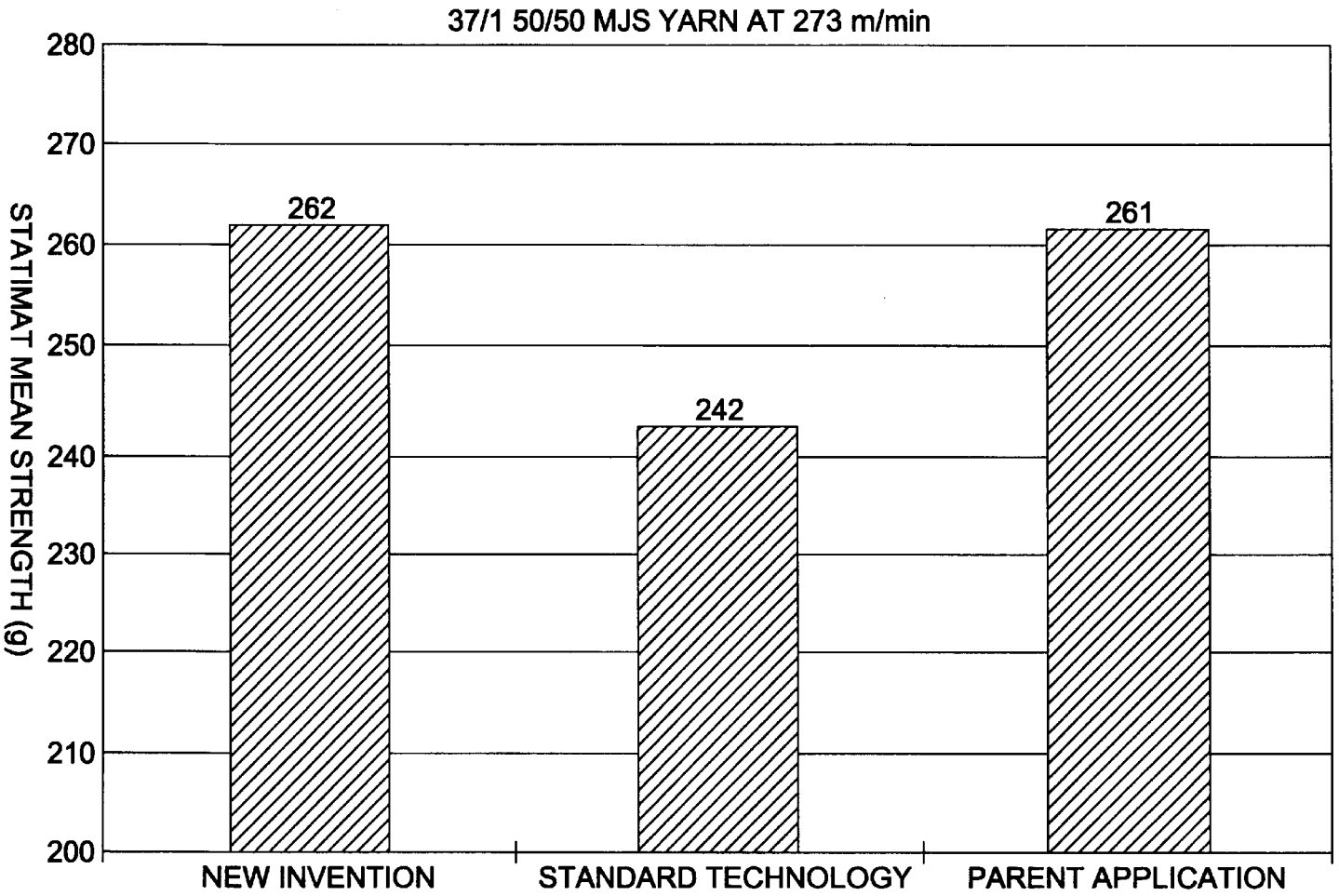

The yarns produced in Example 1A and Comparative Examples 1B and 1C were tested for mechanical properties and uniformity. The mechanical properties of the yarns were tested using both a Statimat testing apparatus at 100 breaks and a Tensojet testing apparatus at 6000 breaks and the yarn quality was determined using a Uster 3 Evenness Tester for 1,000 yards and a Classimat II device for 100,000 meters. The results are provided in TABLE 1, and the Statimat Minimum Strength, Statimat Mean Strength, and Classimat H-1 Defects are also plotted in FIGS. 5, 6 and 7 respectively.

| Sample Number | 1A | 1B | 1C |
|---|---|---|---|
| Effective fiber length (mm) | 39 | 38 | 38 |
| MJS Top Roll Spacings (mm) | 48–37.5–39 | 48–39–42 | 48–36–36 |
| MJS Bottom Roll Spacings (mm) | 44–39–38 | 44–41.5–42 | 44–37–36 |
| Statimat Data (100 breaks) | | | |
| Yarn Count (Ne) | 37.07 | 37.76 | 36.89 |
| Mean Tenacity (gf/den) | 1.83 | 1.72 | 1.81 |
| Second Lowest Tenacity (gf/den) | 1.45 | 1.3 | 1.36 |
| Minimum Tenacity (gf/den) | 1.33 | 1.06 | 1.24 |
| Mean Single-End Strength (gf) | 262 | 242 | 261 |
| Single-End Strength CV (%) | 10.6 | 11.0 | 12.2 |
| Maximum Strength (gf) | 320 | 294 | 346 |
| Minimum Strength (gf) | 192 | 149 | 179 |
| Mean Single-End Elongation (%) | 8.3 | 7.9 | 7.8 |
| Elongation CV% | 8.1 | 10.1 | 8.0 |
| Maximum Elongation (%) | 9.8 | 9.9 | 9.1 |
| Minimum Elongation (%) | 6.7 | 6.1 | 6.0 |
| Tensojet Data (6000 breaks) | | | |
| Mean Tenacity (gf/den) | 1.91 | 1.78 | 1.90 |
| Lowest 1% Tenacity (gf/den) | 1.40 | 1.28 | 1.25 |
| Lowest 0.1% Tenacity (gf/den) | 1.20 | 1.10 | 0.98 |
| Mean Single-End Strength (gf) | 275 | 251 | 273 |
| Single-End Strength CV (%) | 10.8 | 10.9 | 13.8 |
| Maximum Strength (gf) | 376 | 351 | 430 |
| Lowest 1.0% Strength (gf) | 200 | 180 | 180 |
| Lowest 0.1% Strength (gf) | 172 | 155 | 142 |
| Minimum Strength (gf) | 148 | 141 | 136 |
| Mean Single-End Elongation (%) | 8.1 | 7.5 | 7.5 |
| Maximum Elongation (%) | 10.7 | 10.0 | 9.9 |
| Lowest 0.1% Elongation (%) | 5.6 | 4.6 | 4.8 |
| Minimum Elongation (%) | 5.2 | 3.9 | 4.2 |
| Uster 3 Yarn Evenness Data | | | |
| Uster Evenness (CV%) | 18.1 | 18.6 | 18.6 |
| Uster 1 yd Evenness (CV%) | 6.3 | 6.1 | 7.3 |
| Uster 3 yd Evenness (CV%) | 3.8 | 3.7 | 4.5 |
| Uster 10 yd Evenness (CV%) | 2.2 | 2.2 | 2.3 |
| IPI Thin Places (−50%) | 95 | 134 | 134 |
| IPI Thick Places (+50%) | 517 | 615 | 483 |
| IPI Neps (+200%) | 1335 | 1269 | 1520 |
| Total IPI's | 1947 | 2018 | 2137 |
| Classimat Data. | | | |
| A-1 Defects (A1 − A2 − A3 − A4) | 1396 | 1567 | 1344 |
| Major Defects (A4 + B4 + C3 + C4 + D3 + D4) | 8 | 1 | 0 |
| H-1 Defects | 823 | 527 | 1918 |
| H-2 Defects | 4 | 0 | 15 |
| I-1 Defects | 8 | 3 | 43 |
| I-2 Defects | 0 | 0 | 3 |
| Long Thicks (E + F + G) | 3 | 1 | 9 |
| Total Detects | 2242 | 2099 | 3332 |
| Card Sliver Rothschild Cohesion (cN) | 664 | 651 | 651 |
| Third Pass Rothschild Cohesion (cN) | 182 | 182 | 182 |

As shown in TABLE 1, the 50/50 polyester and cotton blends of the invention Example 1A have a 10% average increase in mean Tensojet single-end strength, a 11% average increase in lowest 0.1% Tensojet strength, and a 4% average reduction in the number of total defects, compared to the 50/50 blends prepared by conventional methods in Example 1B. The 50/50 spun yarn has a mean Tensojet single-end strength of greater than 275 gf and less than 2000 total defects per 1000 yards. The total Uster defects per 1000 yards include the number of neps and the number of thick and thin defects in the yarn per 1000 yards. As noted in TABLE 1, a "nep" defect refers to a yarn portion at least 200% thicker than average, a "thick" defect refers to a yarn portion at least 50% thicker than average, and a "thin" defect refers to a yarn portion 50% thinner than average. In addition to these properties, the yarn has a mean Tensojet tenacity of more than 1.91 gf/den, a maximum strength of greater than about 376 gf, and a minimum strength of greater than about 148 gf, each of which are improvements over conventionally produced 50/50 yarn.

Furthermore, a comparison of Examples 1A and 1C show the improvements of the present invention even above those in parent application Ser. No. 08/844,463. The 50/50 polyester and cotton blends of the invention Example 1A have a comparable mean Tensojet single-end strength to Example 1C. However, the current invention exhibits an 21% average increase in lowest 0.1% Tensojet strength, a 9% average reduction in the number of total Uster defects, and a 33% average reduction in the number of total Classimat defects. The total Classimat defects per 100,000 meters includes several classifications of thin and thick places.

The less favorable results for Lowest 0.1% Strenght for Example 1C (Tensojet Data) are somewhat unexpected, but may result from the individual characteristics of the particular spinning machinery used.

Figure 7:
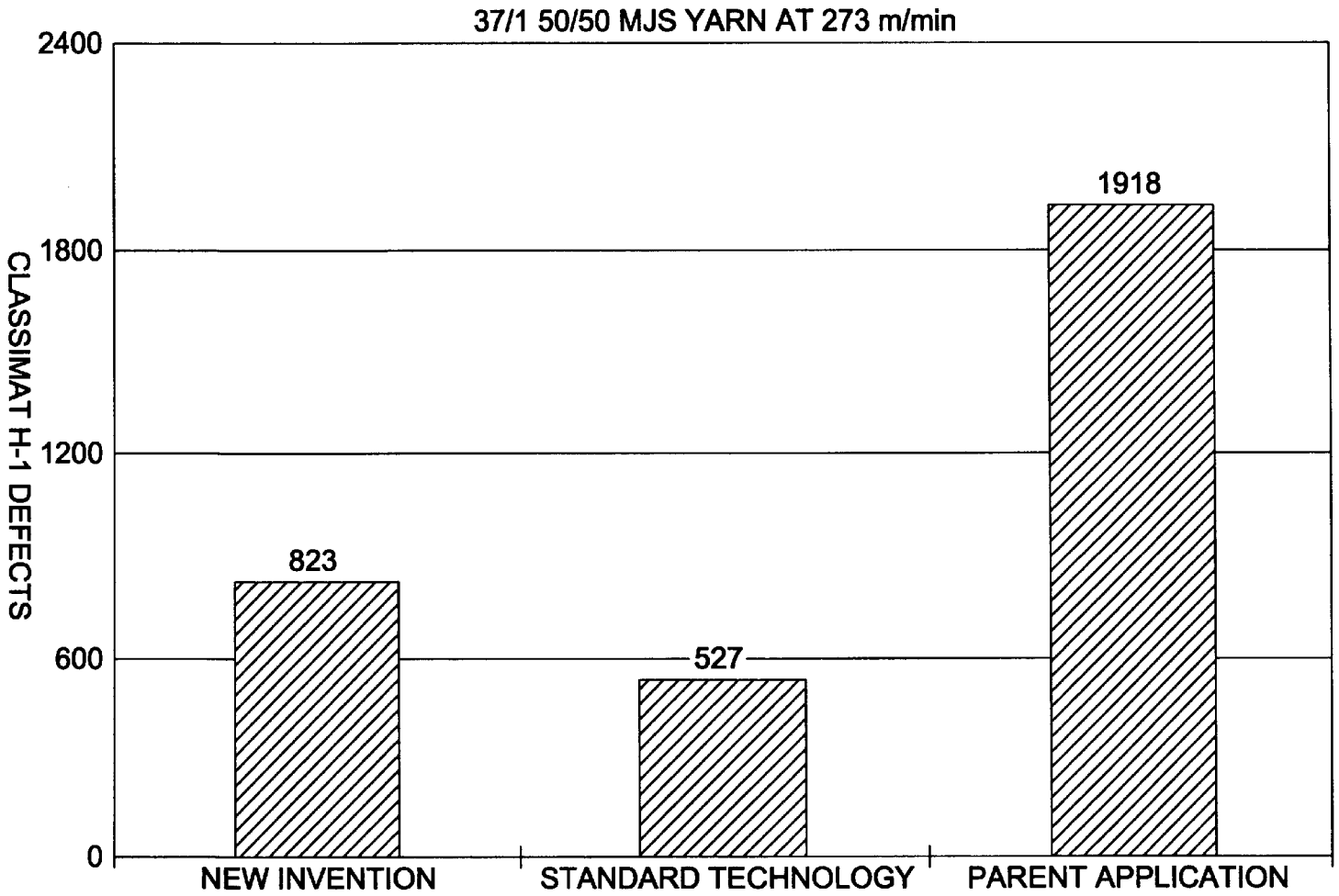

As illustrated by the Classimat Data (Table 1; FIG. 7) yarns produced according to the invention tend to have slightly higher total Classimat defects than do the control yarns. Nevertheless, the difference tends to be minimal, especially when considered in light of the advantages of the novel yarns.

The visible quality of the yarns of the invention is comparable to that in parent application Ser. No. 08/844,463. As illustrated in FIG. 3 (a microscopy photograph of the conventional yarn of Comparative Example 6) and FIG. 4 (a microscopy photograph of the yarn of Example 6 according to the present invention), the yarns of the invention have a visibly superior quality over the conventionally produced yarns. Although not wishing to be bound by a particular theory, it is believed that because of the increased control in the drafting zone of the invention, the wrapper fibers are twisted more frequently around the core fibers; i.e., have a sharper wrapping angle and more wraps per unit length. The resulting improvement in visible quality may be responsible for the decreased defects in the yarn and may also be responsible for the increased mechanical properties of the yarns of the invention.

Although the invention disclosed in parent application Ser. No. 08/844,463 offers these advantages, significantly more machine modification is required which adds a presently significant cost factor to the machinery. In particular, moving the drafting rolls to match the relationships set forth in the '463 application tends to require a large number of adjustments to make things fit. Spring housings must be modified and a different condenser and condenser bracket must be utilized.

Accordingly, in the present invention the distance between the bottom intermediate roll pairs is set to 39 mm so that the aforementioned machine modifications are not required. Thus, in this embodiment of the invention a sliver with fibers of a longest effective length of 39 millimeters was used in a four roll system in which the distance between nips was set at 38.5 millimeters between the back rolls and the first set of intermediate rolls, at 38.25 millimeters between the nips of the intermediate rolls and at 46 millimeters between second intermediate roll pair and the front roll pair.

Stated differently, in the present invention only the intermediate drafting zone has a nip to nip distance that is longer than the effective fiber length. Preferably, the back zone is also maintained near, but slightly less than, the effective fiber length.

It has been further discovered that the strength and quality of yarns produced in this embodiment is greater than those produced in the embodiment of the '463 application.

In the present invention, the back zone is now comparable to the effective fiber length, the intermediate zone is still shorter than the effective fiber length, and a slightly longer stable fiber is preferably used in the process.

With respect to the difference in side plate spacing from conventional spacing, a comparative side plate on the four mentioned MJS spinning machines would include nip spacing of 42 millimeters in the back zone, 40.25 millimeter in the intermediate zone, and 46 millimeters in the front drafting zone. Thus, as Table 2 illustrates, it tends to be mechanically easier to adjust the side plates to take advantage of the present invention as opposed to adjusting the side plates to take advantage of the invention disclosed in parent application Ser. No. 08/844,463.

TABLE 2

| Drafting process versus Nip Spacing | Front | Intermediate | Back |
|---|---|---|---|
| Conventional | 46 | 40.25 | 42 |
| '463 Application | 46 | 36.5 | 36 |
| Invention | 48 | 38.25 | 38.5 |

At present cost structures, applicants estimate that modifying a typical side plate in an air jet spinning machine in the manner disclosed in the present invention is approximately $1/6^{th}$ the cost of the modifications required for the invention disclosed in the '463 application.

It thus appears that in the back drafting zone the most favorable results are obtained when the nip distance is approximately equal to the fiber length while in the intermediate zone the most favorable results are obtained when the nip is shorter than the fiber length.

Although not yet formally demonstrated, it appears that the advantages will likewise extend to other high speed spinning machines such as Vortex type machines that create true twists in an entire yarn.

Again, although applicants do not wish to be bound by any particular theory, it thus appears that the intermediate drafting zone is the most important in terms of yarn strength in these high speed spinning systems. Apparently, the closer the fiber length approaches the nip spacing in the intermediate zone, the higher the drafting force will be on the sliver. Additionally, the intermediate zone is the lowest drafting ratio zone of the entire system. Thus, it appears that the high drafting force in the intermediate zone results in very good alignment.

Set forth in progressive fashion, the nip spacing of the present invention produces a high drafting force in the intermediate zone which in turn produces a better alignment among the staple fibers in the yarn. In turn, the enhanced alignment results in fewer thin places in the yarn and thus a more uniform bundle. In turn, the more uniform bundle produces a tighter wrap during air jet spinning which results in the stronger yarn observed.

Although the above description generally applies to high speed spinning processes, particularly air-jet spinning processes, it will be understood that the invention is not limited thereto since modifications may be made by those skilled in the art, particularly in light of the foregoing description. Therefore, said modifications and embodiments are intended to be included within the spirit and scope of the following appended claims.

That which is claimed is:

1. A drafting and spinning apparatus that produces highly uniform yarns with improved mechanical properties, said apparatus comprising:

a plurality of pairs of drafting rolls for drawing a sliver formed of one or more types of staple fibers, each fiber type having a predetermined effective fiber length, said plurality of pairs of drafting rolls comprising, at least two pairs of intermediate rolls, with the distances between the nips of adjacent intermediate roll pairs being no more than the effective fiber length of the longest fiber type in the sliver; and means for spinning the sliver into yarn at a take-up speed of greater than 150 meters/minute.

2. A drafting and spinning apparatus according to claim 1 wherein said plurality of drafting rolls comprises at least four pairs of drafting rolls, including at least a pair of back rolls and a pair of front rolls.

3. The apparatus according to claim 2 wherein the pair of intermediate rolls adjacent said front roll pair is a pair of apron rolls.

4. The apparatus according to claim 2 wherein the overall draft ratio over said at least four pairs of rolls is between about 50 and about 220.

5. The apparatus according to claim 1 wherein said spinning means is selected from the group consisting of air jet spinning means and roller jet spinning means.

6. The apparatus according to claim 1 wherein the spinning means spins the sliver into yarn at a take-up speed of at least about 190 m/min.

7. The apparatus according to claim 1 wherein the spinning means spins the sliver into yarn at a take-up speed of at least about 220 m/min.

8. An air jet spinning apparatus that produces highly uniform yarns with improved mechanical properties, said apparatus comprising:

a drafting zone of four pairs of drafting rolls for drawing a sliver formed of one or more types of staple fibers, each fiber type having a predetermined effective fiber length, the sliver comprising polyester staple fibers having a denier per filament of between about 0.5 and about 2.5;

said four pairs of drafting rolls consisting of a pair of back rolls, a pair of intermediate rolls adjacent the pair of back rolls, a pair of apron rolls adjacent the pair of intermediate rolls, and a pair of front rolls adjacent the pair of apron rolls; and wherein the distance between the nip of the intermediate roll pair and the nip of the apron roll pair is no more than the effective fiber length of the longest staple fiber type in the sliver.

9. A method of producing highly uniform yarns with improved mechanical properties comprising:

drafting a sliver comprising one or more types of staple fibers, each staple fiber type having a predetermined effective fiber length, by advancing the sliver through a plurality of pairs of drafting rolls comprising, at least two pairs of intermediate rolls, and while maintaining the distance between the nips of adjacent pairs of intermediate rolls at no more than the effective fiber length of the longest staple fiber type in the sliver; and thereafter spinning the sliver into yarn at a take-up speed of more than about 150 meters/minute.

10. The method according to claim 9 said spinning step comprises spinning the yarn at a take-up speed of about 190 meters per minute.

11. The method according to claim 9 said spinning step comprises spinning the yarn at a take-up speed of about 220 meters per minute.

12. The method according to claim 9 wherein the drafting step includes drafting staple synthetic fibers in the sliver.

13. The method according to claim 12 wherein the staple synthetic fibers are selected from the group consisting of polyester, polytrimethylene terephthalate, rayon, nylon, acrylic, acetate, polyethylene, polyurethane and polyvinyl fibers.

14. The method according to claim 12 wherein the drafting step includes drafting natural fibers in the sliver.

15. The method according to claim 14 wherein the natural fibers are selected from the group consisting of cotton, linen, flax, rayon, lyocell, viscose rayon, cellulose acetate, wool, ramie, alpaca, vicuna, mohair, cashmere, guanaco, camel, llama, fur and silk fibers.

16. The method according to claim 9 wherein the drafting step includes drafting staple polyester fibers having a predetermined effective fiber length in the sliver.

17. The method according to claim 16 wherein the drafting step includes drafting high cohesion staple polyester fibers in the sliver.

18. The method according to claim 16 wherein the drafting step includes drafting polyester fibers having a denier per filament of between about 0.5 and about 2.5.

19. The method according to claim 16 wherein the drafting step comprises drafting a sliver consisting of between about 20 and about 100 percent polyester fibers with the remainder of the sliver being cotton fibers.

20. The method according to claim 16 wherein the drafting step includes drafting 100 percent polyester fibers in the sliver.

21. The method according to claim 9 wherein the spinning step is selected from the group consisting of air jet spinning and roller jet spinning.

22. A method of producing highly uniform yarns with improved mechanical properties comprising:

drafting a sliver formed of one or more types of staple fibers, each staple fiber type having a predetermined effective fiber length and one staple fiber type comprising high cohesion staple polyester fibers having a denier per filament of between about 0.5 and about 2.5, by advancing the sliver through a plurality of drafting rolls comprising, a pair of intermediate rolls and a pair of apron rolls, and while maintaining the distance the nip of the pair of intermediate rolls and the nip of the pair of apron rolls at no more than the effective fiber length of the longest staple fiber type in the sliver; and thereafter air-jet spinning the sliver into yarn at a take-up speed of more than about 150 meters/minute.

* * * * *